United States Patent [19]

Denis

[11] Patent Number: 4,977,834

[45] Date of Patent: Dec. 18, 1990

[54] FIREARMS AMMUNITION, PARTICULARLY GAME-SHOOTING AMMUNITION

[76] Inventor: Jean-Pierre Denis, La Croix aux Vents 3bis, Rue Jomard, 78380 Bougival, France

[21] Appl. No.: 399,193

[22] Filed: Aug. 28, 1989

[51] Int. Cl.[5] ..... F42B 5/02; F42B 5/045; F42B 10/48; F42B 30/02

[52] U.S. Cl. ..... 102/439; 102/507; 102/516; 102/517; 102/518

[58] Field of Search ..... 102/430, 439, 507, 514–518

[56] References Cited

U.S. PATENT DOCUMENTS

| | | | |
|---|---|---|---|
| 904,255 | 11/1908 | Gathmann | 102/518 |
| 3,318,244 | 5/1967 | Rostocil | 102/439 |
| 3,348,486 | 10/1967 | Rapp | 102/507 |
| 3,398,682 | 8/1968 | Abela | 102/439 |
| 4,413,564 | 11/1983 | Brown | 102/439 |
| 4,538,520 | 9/1985 | Schmitz | 102/517 |
| 4,572,077 | 2/1986 | Antoine et al. | 102/439 |
| 4,708,063 | 11/1987 | Ladriere | 102/516 |

FOREIGN PATENT DOCUMENTS

| | | |
|---|---|---|
| 2300319 | 11/1977 | France . |
| 2335818 | 6/1978 | France . |
| 0143720 | 11/1984 | France . |
| 2468870 | 7/1986 | France . |

*Primary Examiner*—David H. Brown

*Attorney, Agent, or Firm*—Pollock, Vande Sande and Priddy

[57] ABSTRACT

Ammunition constituted by a case containing a propulsive charge and a subcalibre projectile for a firearm, the projectile comprising:

an internal element (5)

an external element (6) and anti-recoil means (7) for the engagement of the internal element (5) in the external element (6), the internal element (5) comprising:

a front part (8) with a stopping shape, a rear shank (9) connected to the front part, and a percussive mass (10) at least partly fitted over the rear shank (9), and the external element (6) being constituted by:

an aerodynamically-shaped outer casing (19, 13) covering the front and the side walls of the internal element (5) in order to give the projectile good air-penetration, the anti-recoil engagment means (7) ensuring the connection of the internal element (5) and the external element (6) so that at least initially the external element cannot advance more rapidly than the internal element.

19 Claims, 4 Drawing Sheets

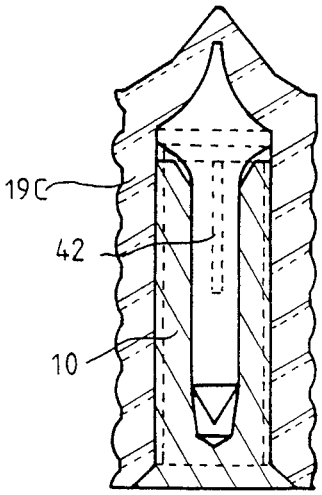
FIG.12A
FIG.12B
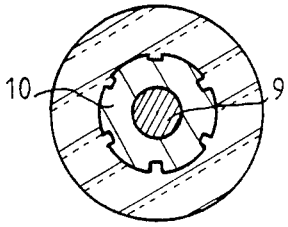
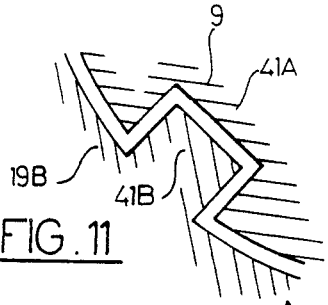
FIG.11
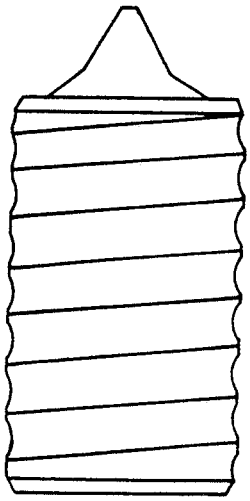
FIG.12C
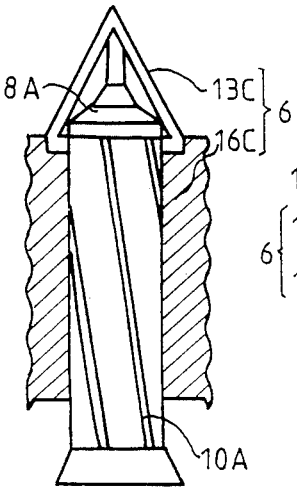
FIG.13
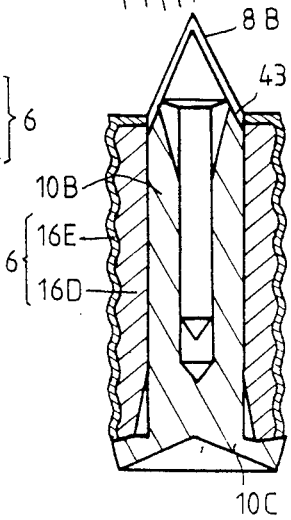
FIG.14

FIREARMS AMMUNITION, PARTICULARLY GAME-SHOOTING AMMUNITION

BACKGROUND OF THE INVENTION

The invention relates to firearms ammunition, particularly game-shooting ammunition.

Such ammunition is already known.

U.S. Pat. No. 2,300,319 relates to a projectile for firearms constituted by a metal part with two different diameters with sharp angles, the whole being surrounded by a covering of plastics material. The purpose of this structure and in particular of the covering of plastics material is to provide the projectile with good air penetration while enabling it to pass the choke of the gun. The projectile is provided with a part which forms a kind of projection which ensures airtightness behind the projectile when it is in the barrel. Moreover, the sharp angles of the moulded part age badly because of the constraints.

This projectile has a number of disadvantages and, in particular is quite complicated to produce, is unstable on its trajectory, which detracts from its accuracy, and finally its stopping power is debatable.

U.S. Pat. No. 2,468,870 relates to a projectile very similar to the aforesaid type of projectile whose rear part is constituted by a cellular part forming the "wad". This projectile has similar disadvantages to the one examined above.

There are also other types of game-shooting projectiles which use the dart principle, for example such as that described in U.S. Pat. No. 2,335,818 or in European Patent No. 0143720.

These two types of projectiles have the disadvantage that their structure is very complicated, particularly from the point of view of their manufacture and their insertion in their cases, and have poor stopping power.

Bullets of the dart type are damaging to the environment and the separation of the parts (from the sabot) and of the dart may disturb its trajectory.

In summary, currently-known game-shooting ammunition such as BRENNEKE, BLONDEAU or SAUVESTRE bullets do not have good stopping power, and moreover, certain ammunition is damaging to the environment because of ricochets from obstacles (trees, etc) which they may encounter on their trajectory.

There is also ammunition known as "cement-factory" ammunition, which is intended for releasing the ring of cement which forms within a cement oven; this ammunition consists simply of a heavy projectile of any shape which is fired from the entrance of the oven towards the ring, in order to break it up.

SUMMARY OF THE INVENTION

The present invention aims to resolve the foregoing problems and proposes the provision of firearms ammunition which can be fired by any kind of firearm, rifled or smooth-bored, and which has excellent firing accuracy and good stopping power, particularly in soft, light targets, etc.

For this purpose, the invention relates to ammunition of the aforesaid type, characterized in that the projectile comprises:

an internal element, an external element, anti-recoil engagement means for the engagement of the internal element on the external element, the internal element comprising:

a front part with a stopping shape, a rear shank connected to the front part, a percussive mass at least partially fitted over the rear shank.

the external element being constituted by:

an aerodynamically-shaped outer casing covering the front and the side walls of the internal element, in order to give the projectile good air-penetration and to prevent wear of the barrel, the anti-recoil engagement means ensuring the connection of the internal element and the external element, so that at least initially the external element cannot advance more rapidly than the internal element.

This ammunition, which is used both as game-shooting ammunition and for other applications, for example such as cement-factory ammunition, etc., has excellent stopping power and can act as an assembled projectile or as a projectile which is preassembled before its mounting in the cartridge. By virtue of the external element, this subcalibre projectile ammunition can be fired by any kind of firearm. In the case of a firearm with a rifled or smooth barrel, if the projectile is assembled, that is to say, if the percussive mass is already fitted completely onto the shank, it behaves like a conventional projectile for this kind of firearm. However, if the projectile is only preassembled, the percussive mass is fitted onto the shank and is locked thereon and locked in the external element when the pressure is increased and, because of the helical grooves, it starts to rotate.

This rotation in a smooth barrel (a game-shooting firearm) ensures the perfect stability of the projectile on its trajectory and provides excellent firing accuracy.

The stopping power can be at two levels, both on impact, as a result of the shape of the internal element of the projectile, and immediately after the impact due to the sliding of the percussive mass on the shank of the internal element. The stopping power is particularly important when the ammunition is used for game-shooting, since it prevents the mere wounding of the game as frequently occurs with current ammunition, particularly "dart"-type ammunition.

Such ammunition can also be envisaged for miniature-range shooting, for training, etc. . . .

According to another characteristic of the invention, the ammunition includes sealing means between the internal element and the external element on the one hand, and between the external element and the barrel on the other hand. The sealing means ensure the complete effectiveness of the propulsive charge while preventing the gases from causing the different elements of the projectile to become detached.

According to another characteristic, the external element is less heavy than the internal element.

This characteristic is particularly important for firing accuracy, because of the stabilization of the projectile on its trajectory.

According to another characteristic, the front stopping part of the internal element is a solid of revolution which is essentially conical in shape with a generatrix which is not necessarily straight and with a base which is wide compared with its height; the front stopping part has a forwardly-open axial cavity.

It is particularly advantageous that the rear shank is connected to the front part so as to form a shoulder which the percussive mass can abut during its relative translational movement.

According to another characteristic, the shoulder between the front end and the rear shank is extended by a reversed conical part. This reversed conical part enables the percussive mass to be made to pass over the stopping part at the moment of impact of the bullet. It is particularly advantageous that the rear shank includes cutting ribs immediately behind the shoulder formed with the front end. The percussive mass thus considerably increases the stopping effect of the projectile.

According to another characteristic, the shank includes annular grooves which serve as release elements. These annular grooves facilitate the sliding of the percussive mass on the shank.

According to another characteristic, the shank has a conical cross-section with its apex directed rearwardly, so that during the forward movement of the percussive mass relative to the shank, the conical shape acts as a wedge.

According to another characteristic, the rear end of the shank is pointed, so as to pierce the percussive mass at the moment of impact with the target.

According to another characteristic, the front end and the rear shank are produced in the form of a sleeve whose front end is hammered out to form a point with a flattened part behind it forming a projection, thus forming the front stopping end, the whole being filled by a mass, in particular a lead mass, or an active mass. This embodiment is particularly simple and advantageous from the point of view of its manufacture.

According to another characteristic, the percussive mass is in the form of a sleeve whose cross-section corresponds substantially to the annular cross-section of the space between the inner surface of the external element and the surface of the rear shank, the sleeve terminating at the rear in an external projection which bears against at least part of the base of the external element.

According to another characteristic, the sleeve forming the percussive mass has longitudinal break-initiaters.

According to another characteristic, the external surface of the percussive mass is provided with helicoidal ribs (grooves) for imparting a rotational impulse to the external element upon the departure of the shot, the external element being provided with complementary grooves or ribs.

According to another characteristic, the external element is in the form of a sleeve provided with a front part which forms an aerodynamic cover for the front stopping part of the internal element.

According to another characteristic, the sleeve and the front part are formed in a single piece.

According to another characteristic, the sleeve has an external surface with longitudinal helicoidal or annular ribs/grooves.

According to another characteristic, the anti-recoil engagement means between the internal element and the external element are constituted by engagement scoring or ribs formed in the outer surface of the sleeve of the internal element or the internal surface of the external element.

The invention will be described in more detail with the aid of various examples shown schematically in the appended drawings, in which:

BRIEF DESCRIPTION OF THE DRAWINGS

FIG. 11 is a detail of FIG. 10B, FIG. 12A is a section of a sixth variant of the invention, FIG. 12B is a section taken perpendicular to the axis of the variant of FIG. 12A, FIG. 12C is a side view of the projectile according to FIG. 12A, FIG. 13 and 14 are sections of other variants of the projectile according to the invention.

DESCRIPTION OF THE PREFERRED EMBODIMENTS

Figures 1, 2, 3, 4, 5, 6A, 6B:
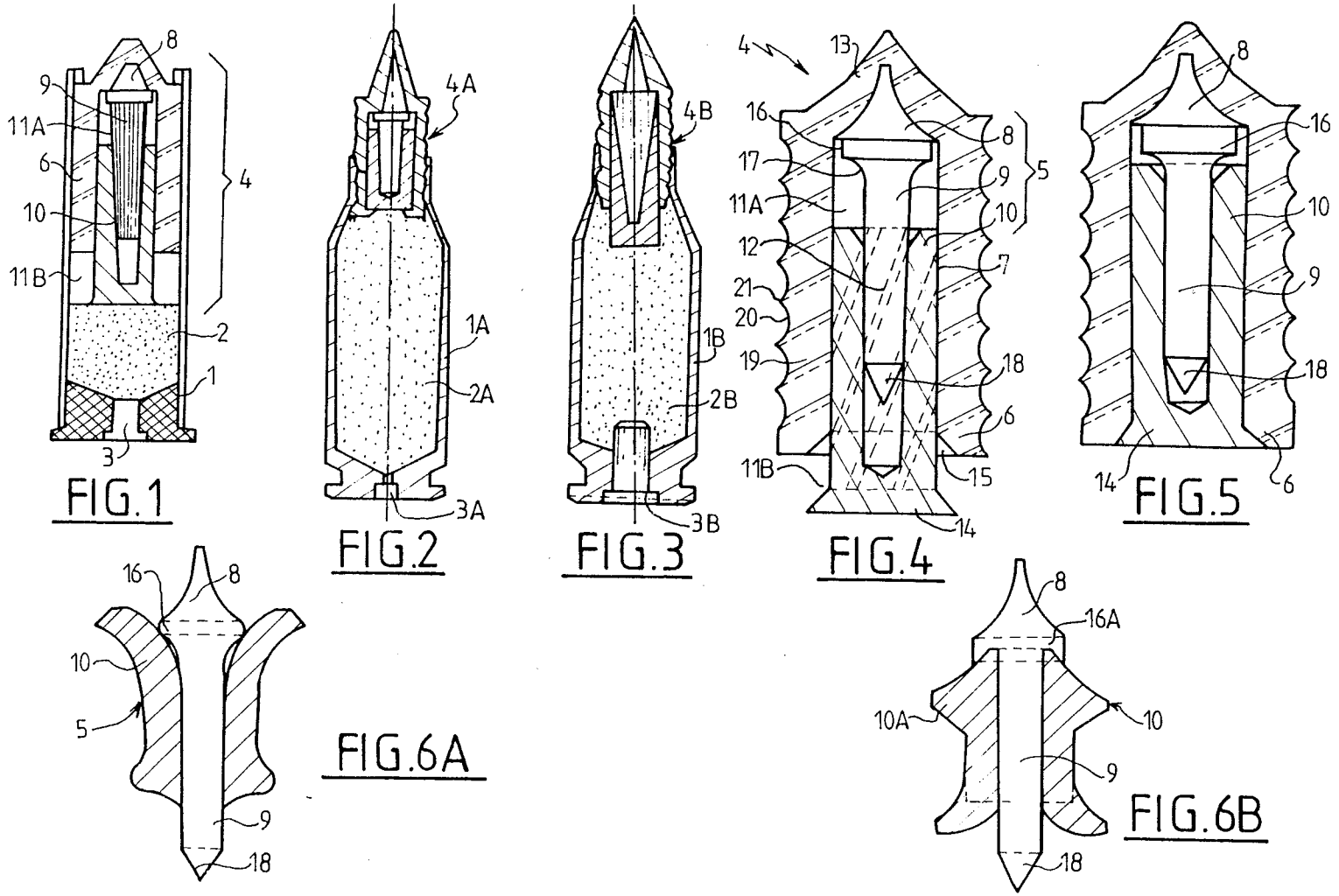
FIG. 1 is a schematic sectional view of an assembled piece of ammunition according to the invention.
FIG. 2 shows a variant of the ammunition according to the invention.
FIG. 3 shows another variant of the ammunition according to the invention.
FIG. 4 is a section of the projectile of the ammunition according to the invention, the percussive mass being in the retracted position (preassembly)
FIG. 5 is a section of the projectile of FIG. 4, the percussive mass being in the forward position.
FIG. 6A is a section of the internal element of the projectile after impact, according to a first possibility.
FIG. 6B shows the internal element of the projectile after impact, according to a second possibility.

According to FIG. 1, the invention relates to a piece of ammunition constituted by a case 1 containing a propulsive charge 2 with a detonator 3 and subcalibre projectile 4. This ammunition is intended for a smooth-barrelled firearm.

FIGS. 2 and 3 show two other variants of cartridges with cases 1A, 1B and detonators 3A, 3B with charges 2A, 2B and projectiles 4A, 4B.

According to FIG. 4, the projectile shown in section is composed of an internal element 5 and an external element 6 as well as anti-recoil engagement means 7 for engagement between the internal element 5 and the external element 6. The anti-recoil engagement means may, for example, comprises an arrangement of the type shown at 7A in FIG. 8, or at 7B in FIG. 9, or at 7C in FIG. 10A, or at 47 in FIG. 18, as will be described hereinafter.

The internal element 5 includes a front part 8 which has a stopping shape and a rear shank 9 connected to the front part 8. The internal element 5 also includes a percussive mass 10 which is fitted, at least partly, onto the rear shank 9. There is also a space 11A between the front part 8 and the front end of the percussive mass 10, which enables the percussive mass to move forward on the shank 9 upon the departure of the shot and to impart to the projectile a rotational impulse, as will be explained below.

The forward movement of the percussive mass upon the departure of the shot is progressive and damps the recoil effect of the firearm. Moreover, there is also a space 11B behind the sleeve 19, in front of the powder charge; the air trapped in these two spaces 11A, 11B serves as a shock-absorbing cushion.

Figure 17A:
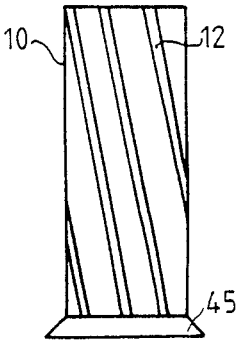
FIG. 17A is a side view of a percussive mass.
Figure 17B:
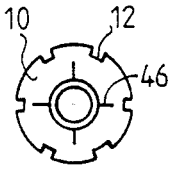
FIG. 17B is a section taken perpendicular to the axis of the percussive mass of FIG. 17A.
Figure 18:
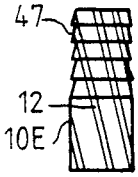
FIG. 18 is a front view of a variant of the percussive mass showing the engagement means.

As shown in FIG. 4 the percussive mass 10 includes helicoidal ribs or grooves 12 so that translational movement of mass 10 onto the shank 9 upon the departure of the shot causes the external element 6 to start to rotate, by a screwing effect. The grooves 12 are also shown in FIGS. 17A, 17B and 18, but have not been shown in the other figures to simplify the drawing.

The external element 6 is constituted by an outer covering, of which the front part 13, in particular surrounds it, so as to cover the front and the side walls of the internal element 5, to give the projectile an aerodynamic shape, ensuring its good air-penetration.

The anti-recoil engagement means 7 generally ensure the connection of the internal element 5 and the external element 6 so that upon the departure of the shot, the external element 6 cannot become detached from the internal element 5 as a result of the forces applied by the pressure of the propulsion gases of the chamber of the firearm. However, at least when the arrangement of the percussive mass is that of FIG. 4, these engagement means 7 enable the movement of percussive mass 10 onto the shank 9 to continue, so that the rotational impulse is imparted to the external element 6 and consequently to the projectile as a whole.

The lower end of the percussive mass 10 includes a frusto-conical projection 14 which is intended to be housed in a tapered part 15 of substantially corresponding shape at the mouth of the housing which is not indicated by a reference numeral, but is defined by the external element 6, and houses the internal element 5.

This annular projection 14 cooperating with tapered part 15 constitutes a sealing means which prevents the gases from penetrating into the gap between the internal element 5 and the external element 6, risking the detachment of the external element 6, upon the departure of the shot, once the percussive mass is fitted completely onto the shank 9. Sealing means are also provided for the contact between the external element 6 and the surface of the barrel. These means are described in more detail below.

The front stopping part 8 of the internal element 5 is preferably a substantially-conical solid of revolution. The generatrix of the cone is not necessarily a straight line and may to advantage be constituted by a curve, for example the cone may have a "concave" surface shaped as a circular arc, etc. in order to ensure better penetration of the projectile into the target with a stopping effect. It should be noted that, in order to improve this stopping effect, the cone is very flattened, that is the apex angle is very wide, the base of the cone being wide compared with its height.

The shank 9 is connected to the front part 8 forming a large shoulder 16, which the percussive mass 10 abuts during its translational movement on the shank 9. This abutment or contact has intentionally not been shown in FIG. 4. Upon the departure of the shot, the percussive mass 10 may also stop moving on the shank 9 at a certain distance from the shoulder 16, the abutment occurring only at the moment of impact. After this movement, the percussive mass may remain stopped or may continue to move.

According to the embodiment of FIGS. 4 and 5, behind the shoulder 16 is a reversed conical solid of revolution shape 17.

According to another variant described below, the conical shape 17 behind the shoulder 16 is replaced by cutting ribs, which at the moment of impact, cause the percussive mass to open out like a tulip.

According to the schematic drawing of FIG. 1, the shank 9 has a conical cross-section the apex of the cone being directed rearwardly so that when the percussive mass 10 moves forwards on the shank 9, the conical shape of the shank 9 creates a wedging effect, spreading out the percussive mass thus causing the external element 6 to spread out and become locked on the internal element 5.

According to FIG. 2, the rear end 18 of the shank 9 is pointed in shape, so as to pierce the base of the percussive mass at the moment of impact of the projectile with the target, in order to improve the penetrating and stopping effect of the percussive mass 10 on the target.

It should be noted that, as will be described below, the percussive mass 10 is in the form of a sleeve whose cross-section substantially corresponds to the annular cross-section of the space between the internal surface of the external element 6 and the external surface of the rear shank 9. The fit of the dimensions is quite accentuated, in order to create a clamping effect which becomes progressive as a result of the relative conicities of the shape of the percussive mass and of the shape of the shank 9, as well as of the diametral expansion effect created by the anti-recoil engagement means 7 between the internal element 5 and the external element 6. The external element 6 also expands slightly and this compensates for wear of the barrel.

According to FIG. 4, the sleeve 19 which constitutes the cylindrical shape of the external element 6, has ribs, grooves or channels 20, 21 which, in this embodiment are annular, in order to reduce friction between the external element 6 of the projectile and the surface of the firearm barrel.

The internal housing formed by the sleeve 19 is often cylindrical in shape, but in certain cases, in order to improve the grip between the percussive mass 10 and the external element 6 (the sleeve 19) upon the departure of the shot, it may be advantageous for this housing to be formed with a reverse-tapered shape, (that is flared forwardly).

In the following description, further means for improving the grip, that is the engagement between the percussive mass 10 and the sleeve 19 (that is the external element 6), will be considered.

FIG. 5 shows the position of the internal element 5, and in particular of the percussive mass 10 which has been driven into the external element 6, in the manner in which these different parts are arranged in the projectile at least after the departure of the shot.

In effect, according to the invention and for reasons of use, it may be advantageous for the projectile to be mounted in the cartridge either in the position shown in FIG. 4, that is with the percussive mass 10 retracted from the external element 6, or with the percussive mass 10 already driven home as shown in FIG. 5.

FIG. 6A shows the condition of the internal element 5 of the projectile at the moment of its impact on the target, which is not shown. At this moment, the external element is held against the surface of the target, which it penetrates slightly while the internal element penetrates the target, in order to stop it. At the moment when the front part 8 hits the target, and under the effect of the deceleration undergone by the element (8, 9), the percussive mass 10 continues to advance as a result of its kinetic energy and opens out as it passes over the shoulder 16 of the part 8. As will be seen below, this opening out can be encouraged by ribs which cut the percussive mass 10 into strips so that it opens out like a tulip and increases the stopping effect of the projectile.

The end 18 of the shank 9 encourages the percussive mass to move forwards relative to the shank 9, since this end facilitates the piercing of the base of the percussive mass and deforms it as shown schematically in FIG. 6A.

FIG. 6B shows a different situation which results from the different shape of the shoulder 16A which has a rearwardly-facing groove into which the percussive mass 10 is inserted at the moment of impact when it tries to move forwards, under the effect of its energy, relative to the shank 9. In this case, it does not pass over the front part 8, but increases the energy of the latter. The way in which the percussive mass 10 is compressed is shown schematically in the drawings.

Figure 7:
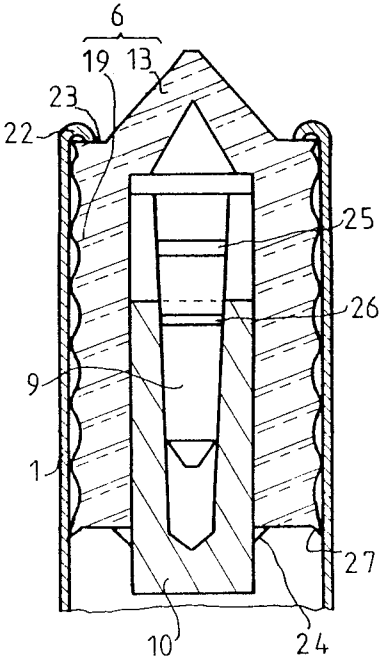
FIG. 7 is a section similar to FIG. 4 of the projectile according to a second variant of the invention.

FIG. 7 shows a second variant of the ammunition according to the invention. This variant shows a part of the case 1 whose upper end 22 is turned over onto the shoulder 23 formed between the upper part 13 and the sleeve 19 of the external part 6. This figure shows the arrangement of the sealing means in the form of a lip 24 which is provided at the base of the sleeve 19 and bears against the external surface of the percussive mass 10, to cover the latter once it is driven home onto the shank 9. The figure also shows the grooves which form annular release elements 25, 26 in the shank 9, for facilitating the sliding of the percussive mass 10 on the shank 9.

Finally, the outer edge of the sleeve 19 is provided with sealing means level with its base, in the form of a lip 27 which is applied against the case 1 but which, once the projectile is in the barrel, ensures sealing with the wall of the barrel in order to avoid gas losses and wobbling of the projectile.

Figure 8:
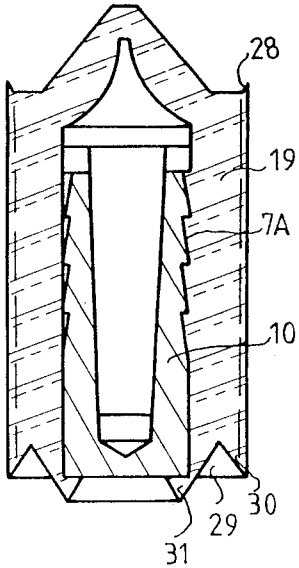
FIG. 8 is a section similar to FIG. 5 of a third variant of the invention.

FIG. 8 shows a third variant of the ammunition projectile according to the invention. This variant differs from the previous embodiments in that it has lips 28 at the top of the sleeve 19 of the external element 6 as well as an annular groove 29 formed in the base of the sleeve 19 defining an external lip 30 for sealing between the external element 6 and the barrel, as well as an internal lip 31 which ensures the seal between the sleeve and the percussive mass 10. It will be noted that the lips 30 and 31 are shaped, in particular, with large surfaces which are subjected to the gas pressure and thus ensure a perfect seal.

This figure also shows a particular embodiment of the anti-recoil engagement means 7. This is a saw-toothed profile 7A formed either in the percussive mass 10 or in the internal surface of the element 6 or in both surfaces. Moreover, it is not essential for the shapes of the engagement means to correspond exactly.

According to a variant not shown, the internal surface of the sleeve 19 includes anti-recoil lips.

Figure 9:
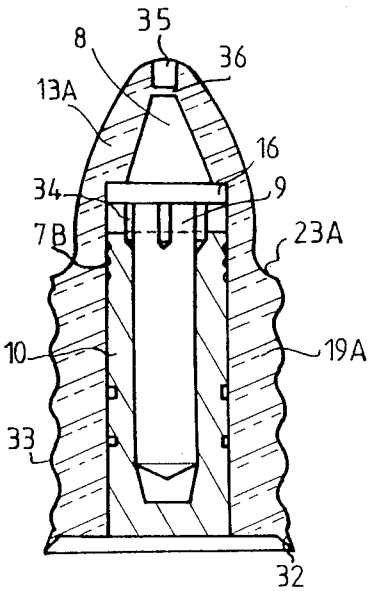
FIG. 9 is a section similar to FIG. 5, showing a fourth variant of the invention.

FIG. 9 shows another variant of the ammunition projectile according to the invention. This variant differs in the shape of the sleeve 19A and the lower position of the shoulder 23A which serves for clamping the projectile in the case (not shown). The sleeve 19A has a perimetral sealing lip at its bottom. The outer surface of the sleeve 19A has corrugations 33 which have the same functions as the corrugations of the embodiments described above.

The shank 9 has several cutting ribs 34 at the level at which it is connected to the shoulder 16 of the front part 8, for cutting the percussive mass 10 upon impact when it tries to slide over the shoulder 16 as a result of its energy.

This drawing also shows another embodiment 7B of the anti-recoil engagement means 7; the engagement means 7B is in the form of one or more screw threads.

Finally, the front part 13A of the external element is arch-shaped and its front end has a cavity 35 for facilitating its piercing by the front part 8 of the projectile at the moment of impact. A thin film 36 closes the bottom of the cavity 35 to prevent damp from penetrating the projectile.

Figure 10A:
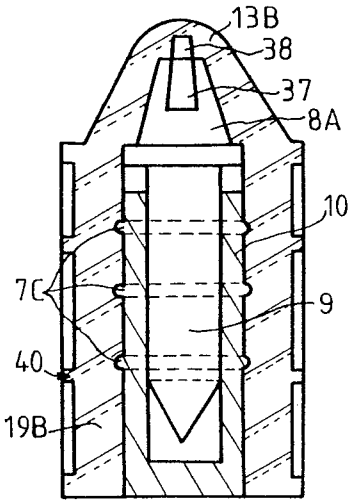
FIG. 10A is a section similar to FIG. 5 of a fifth variant of the invention.
Figure 10B:
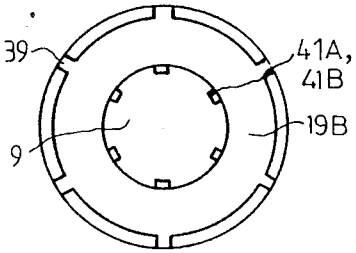
FIG. 10B is a section taken perpendicular to the axis of the variant of FIG. 10A.

FIGS. 10A, 10B show another variant. This variant differs from the previous embodiments in the shape of the front part 8A, which includes a cavity 37, and in the shape of the front part 13B of the external element 6 which also has a cavity 38 which forms an extension of the cavity 37. The percussive means 10 has perimetral projections 7C which form anti-recoil engagement means. Finally, the outer surface of the sleeve 19B is provided with longitudinal ribs 39 and transverse ribs or studs 40 for reducing the area of contact between the sleeve 19B and the external element and the surface of the barrel.

FIG. 10B and the partial enlargement of FIG. 11 show the threads 41A, 41B which establish rotation. The male/female threads may have various cross-sections (rectangular, square, trapezoidal, symmetrical or asymmetrical) in order to encourage entrainment in rotation by the perfect engagement between the two parts.

FIGS. 12A and 12B show a sixth variant of the invention. This variant differs from the previous embodiments mainly in the shape of the external surface of the sleeve 19C as well as by the presence of cut-initiators 42 formed in the percussive mass (as will be explained below).

FIG. 12C is a side view of the projectile of FIGS. 12A and 12B.

FIG. 13 shows another variant. In this figure, the external element 6 is in two parts, a cap 13C and a sleeve 16C, which are firmly fixed together. Moreover, the percussive mass 10A is fixed directly to the front part 8A.

The variant shown in FIG. 14 is slightly different in the shape of the percussive mass 10B which has a flared part 43 at the front which facilitates its passage over the arrow-shaped point 8B which constitutes the stopping part. Finally, the external part 6 is constituted by a first sleeve 16D and a cover 16E. Moreover, the base 10C of the percussive mass bears against the base of the external element 6 to prevent its detachment upon firing.

It should be noted that in the various FIGS. 8, 9, 10A, 12A, 13, and 14, the percussive mass is already driven home into the external element (assembly). As stated above, this condition may be achieved intentionally during the manufacture of the cartridge, or, more generally, may represent the relative positions of the different parts of the projectile after the shot has departed and been set in rotation.

Figure 15:
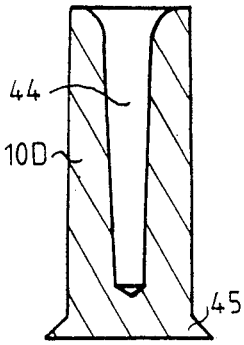
FIG. 15 is an axial section of an embodiment of a percussive mass.
Figure 16:
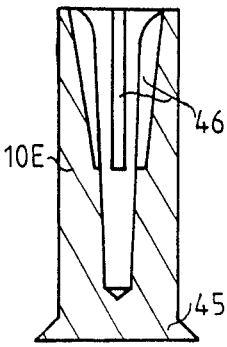
FIG. 16 is an axial section of a variant of the percussive mass of FIG. 15.

FIGS. 15 and 16 show two embodiments of a percussive mass. According to FIG. 15, the percussive mass 10D has a conical housing 44 which is flared like a trumpet at its upper end. At its lower end, the percussive mass terminates in a conical projection 45 for improving the seal.

The embodiment of the percussive mass 10E of FIG. 16 is similar to that of the percussive mass 10D of FIG. 15, except that this percussive mass includes longitudinal break-initiaters which facilitate the opening out of the percussive mass at the moment of impact.

FIGS. 17A and 17B show the external grooved shape of a percussive mass 10. These figures show the helical grooves 12, and in the case of the second of FIG. 17B, the break-initiaters 46.

Figure 19:
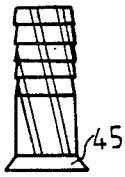
FIG. 19 is another variant of a percussive mass.

FIGS. 18 and 19 show other embodiments of the percussive mass. The percussive mass 10E of FIG. 18 also includes helicoidal grooves 12 as well as rings 47 with saw-tooth shaped cross-sections, constituting the anti-recoil engagement means.

The variant of FIG. 19 differs from that of FIG. 18 in that it has a conical sealing projection 45 at its lower end.

Figure 20:
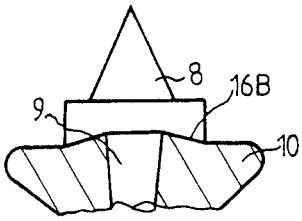
FIG. 20 shows the front region of the internal element of a projectile upon impact.

FIG. 20 is an enlarged view of a variant of the front part 8 and in particular of the shoulder 16B with respect to the embodiment of FIG. 7, for retaining the percussive mass 10 at the moment of impact, so as to prevent it from opening out and spreading over the shoulder 16B, as it slides on the shank 9. In this case, as in that of FIG. 7, the percussive mass 10 imparts its energy to the stopping part 8 and remains firmly fixed thereto.

Figure 21:
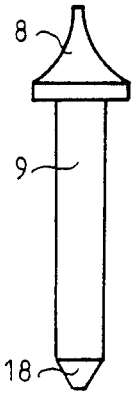
FIG. 21 is a view of an embodiment of an internal projectile element.

FIG. 21 shows in detail the single-piece unit formed by the stopping part 8 and the shank 9 with a pointed end 18.

Figure 22:
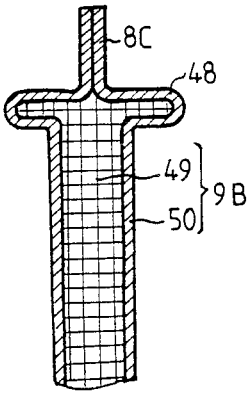
FIG. 22 is a section of a variant of the internal element of ammunition according to the invention.

FIG. 22 shows a variant of the part shown in FIG. 21. In this variant, the stopping part 8C is constituted by a tube which has been hammered out and flattened to form a region 48, plus a shank 9B which is formed by a filling 49, for example of lead or of an active mass and a sheath 50 formed by the sleeve which forms the parts 8C and 48.

Figure 23:
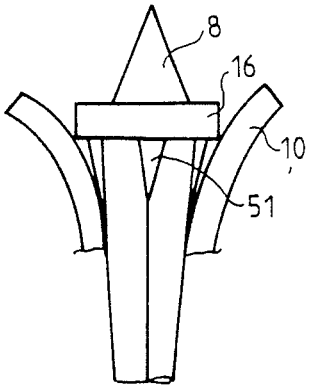
FIG. 23 shows another variant of the internal element according to the invention showing the opening out of the percussive mass upon impact.

Finally, FIG. 23 shows a particular embodiment of knife-shaped ribs 51 situated upstream of the shoulder 16 of the stopping part 8 in order to open out the percussive mass 10 more easily and more effectively.

I claim:

1. Ammunition comprising a case containing a propulsive charge and a subcalibre projectile for a firearm, said projectile including an internal element, an external element, and anti-recoil engagement means between said internal element and said external element for connecting said internal and external elements to one another;

said internal element comprising a front part having a stopping shape, a rear shank connected to said front part, and a percussive mass at least partially fitted over said rear shank for translational movement of said percussive mass along said rear shank;

said external element comprising an aerodynamically-shaped outer casing covering the front and the side walls of said internal element in order to give the projectile good air-penetration; and said anti-recoil engagement means so connecting said internal element and said external element to one another that, at least initially after firing of the projectile, said external element cannot advance more rapidly than said internal element.

2. Ammunition according to claim 1, including sealing means between the internal element on the one hand and the external element on the other hand, and the case.

3. Ammunition according to claim 1, wherein the external element is less heavy than the internal element.

4. Ammunition according to claim 1, wherein the front part of the internal element is a solid of revolution which is substantially conical in shape and has a base which is wide compared with its height.

5. Ammunition according to claim 1, wherein the front part has a forwardly-open axial cavity.

6. Ammunition according to claim 1, wherein the rear shank includes annular grooves which serve as release elements.

7. Ammunition according to claim 1, wherein the rear shank has a conical cross-section with its apex directed rearwards so that during forward movement of the percussive mass relative to the shank the conical shape acts as a wedge.

8. Ammunition according to claim 1, wherein the shank has a rear end which is pointed so as to pierce the percussive mass at the moment of impact of said projectile with a target.

9. Ammunition according to claim 1, wherein the front part and the rear shank are produced in the form of a sleeve having a flattened front end forming a point, and a further flattened part behind said front end forming a projection that is transverse to said front end, the sleeve being filled with a weighted mass.

10. Ammunition according to claim 1, wherein the external element is in the form of a sleeve provided with an aerodynamic cover for the front part of the internal element.

11. Ammunition according to claim 1, wherein the outer casing and the front part are formed in a single piece.

12. Ammunition according to claim 1, wherein the outer casing has an external surface provided with ribs and grooves.

13. Ammunition according to claim 1, wherein the anti-recoil engagement means between the internal element and the external element is in engagement with scoring or ribs formed in the outer surface of the internal element or the inner surface of the external element.

14. Ammunition according to claim 1, wherein the rear shank is connected to the front part so as to form a shoulder against which the percussive mass can abut during translational movement of said mass relative to said rear shank.

15. Ammunition according to claim 14 wherein the shoulder between the front part and the rear shank is extended by a reversed conical part.

16. Ammunition according to claim 14 wherein the rear shank includes cutting ribs immediately behind the shoulder.

17. Ammunition according to claim 1, wherein the percussive mass is in the form of a sleeve whose cross-section corresponds substantially to the annular cross-section of a space between external element and the outer surface of the rear shank, the sleeve terminating at the rear end thereof with an external projection which bears against a least part of the base of the external element.

18. Ammunition according to claim 17, wherein the sleeve forms the percussive mass and has longitudinal break-initiaters.

19. Ammunition according to claim 17, wherein the external surface of the percussive mass is provided with helicoidal members for imparting a rotational impulse to the external element upon the departure of the projectile from the case, the external element being provided with members that are complementary to said helicoidal members.

* * * * *